US005232306A

United States Patent [19]

Sterner

[11] Patent Number: 5,232,306

[45] Date of Patent: Aug. 3, 1993

[54] CRACKFILLING VEHICLE

[76] Inventor: Carl L. Sterner, 3860 Nord Rd., Bakersfield, Calif. 93312-9215

[21] Appl. No.: 804,649

[22] Filed: Dec. 10, 1991

[51] Int. Cl.[5] ..... E01C 19/12; E01C 23/02; E01C 19/18

[52] U.S. Cl. ..... 404/107; 404/107; 404/111

[58] Field of Search ..... 404/91, 92, 96, 101-103, 404/108, 111-113, 83, 107, 86, 72, 75, 77-80; 222/146

[56] References Cited

U.S. PATENT DOCUMENTS

| | | | |
|---|---|---|---|
| 1,165,331 | 12/1915 | Gray . | |
| 1,397,045 | 11/1921 | Finley . | |
| 1,750,104 | 3/1930 | Heltzel . | |
| 2,420,410 | 5/1947 | Blankner | 94/39 |
| 2,578,080 | 12/1951 | Middlestadt | 94/39 |
| 2,669,915 | 2/1954 | McConnaughay | 94/44 |
| 3,020,812 | 2/1962 | Gross | 404/107 |
| 3,260,176 | 7/1966 | Bowers | 94/39 |
| 3,398,662 | 8/1968 | Takata et al. | 94/39 |
| 3,519,169 | 7/1970 | Holland et al. | 222/178 |
| 3,712,681 | 1/1973 | Marino et al. | 302/20 |
| 3,771,893 | 11/1973 | Miller | 404/101 |
| 3,822,955 | 7/1974 | Haferkamp et al. | 404/72 |
| 3,873,227 | 3/1975 | Goethe et al. | 404/107 |
| 4,069,182 | 1/1978 | McDonald | 404/72 X |
| 4,072,435 | 2/1978 | Coho, Jr. et al. | 404/110 |
| 4,124,325 | 11/1978 | Cutler | 404/75 |
| 4,423,980 | 1/1984 | Warnock | 404/83 |
| 4,453,856 | 6/1984 | Chiostri | 404/91 |
| 4,473,320 | 9/1984 | Register | 404/91 |
| 4,511,284 | 4/1985 | Sterner | 404/111 |
| 4,534,674 | 8/1985 | Cutler | 404/75 |
| 4,603,999 | 8/1986 | Laditka | 404/112 |
| 4,695,186 | 9/1987 | King | 404/111 |
| 4,744,693 | 5/1988 | Smith | 404/77 |
| 4,820,078 | 4/1989 | Brocious | 404/92 |
| 4,828,429 | 5/1989 | Kirchner | 404/111 |

FOREIGN PATENT DOCUMENTS

| | | |
|---|---|---|
| 841060 | 5/1939 | France . |
| 2530694 | 3/1982 | France . |
| 732433 | 5/1980 | U.S.S.R. . |

*Primary Examiner*—Thuy M. Bui
*Assistant Examiner*—Nancy P. Connolly
*Attorney, Agent, or Firm*—John W. Montgomery

[57] ABSTRACT

A vehicle for transporting and dispensing materials required for filling and repairing cracks in roadways and highways or similar traffic-bearing surfaces comprises a supply tank for asphalt mix or emulsion or the like liquid crack-filling material, a hose leading from the asphalt supply tank to a dispensing area adjacent the vehicle, a directable applicator connected to the hose for directing crack-filling materials from the asphalt supply tank into cracks in the roadway, a resilient squeegee blade supported from the vehicle for dragging across the roadway dispensing area after crack-filler material is directed into cracks so that the crack-filler material is leveled, a hopper for carrying sand, rock chips, or other substantially dry structural material for covering the liquid crack-filler material and binding therewith to form in the aggregate substantially firm roadway surfaces, a dispensing broadcaster attached to the vehicle adjacent the dispensing area, and a conveyor interconnected with the hopper for moving sand or other structural filler material therefrom to the dispensing broadcaster.

6 Claims, 1 Drawing Sheet

CRACKFILLING VEHICLE

BACKGROUND OF THE INVENTION

1. Technical Field of the Invention

The present invention relates to a vehicle designed for filling cracks in roadways and other traffic-bearing surfaces, and in particular, to a crackfilling vehicle designed for filling multiple cracks in a localized area of several square feet, sometimes known as "alligator cracks" because of the irregular resemblance of the surface to the skin on the back of an alligator.

2. Description of Related Art

Prior crackfilling machines such as the ones disclosed in my previous U.S. Pat. No. 5,006,012 have been designed for applying crackfilling material conveniently in areas immediately adjacent the vehicle. Such vehicle can be conveniently moved in the direction of the crackfilling area. Hand wand operators walk ahead of the vehicle in the direction of movement. Such vehicles have also been designed with aggregate or sand hoppers and sand broadcasting or spreading devices to facilitate the spreading of an aggregate sand which combines with the crackfilling material to reduce set-up time and to allow rapid use of the roadway shortly after crackfilling repair has been completed.

One difficulty with the previous known vehicles is that if excess crackfilling material is sprayed, ridges or bumps resulted as the asphaltic crackfill material solidifies. Such bumps not only provide a potentially rough traffic surface but also the impact of wheels of vehicles upon the raised portions localize the forces on the roadway in a manner which accelerates subsequent deterioration of the repaired roadway surface. In the past, these raised portions were manually leveled using hand-held squeegees, which is a labor-intensive and slow operation.

Further, the invention of a cold-applied, crackfilling material, hand wand and method of application of the cold-filled crackfilled material which is the subject of a concurrently filed co-pending application by the present inventor, has given rise to a need for modified capabilities to the crackfilling vehicle.

Thus, it is an object of the present invention to provide an improved crackfilling vehicle having the capabilities of automatically squeegeeing applied crackfilled material.

It is a further object of the invention to provide a vehicle having versatile capabilities for applying hot crackfiller material, ductile emulsion crackfiller material, or cold-applied, quick-setting rubberized asphalt material.

SUMMARY OF THE INVENTION

The advantages of improved crackfilling and in particular, crackfilling of alligator cracks with reduced labor has been achieved through the invention of a crackfill machine which is driven in the direction of crackfilling, has crackfill material applicator wands and supply hoses supported from the vehicle in the direction of vehicle movement, has a unique rubber squeegee attached laterally across the back of the vehicle and which is adjustably positionable for squeegeeing large areas of the roadway in the direction of motion of the vehicle, and has an automatic sand spreader for covering the filled cracks with aggregate sand material.

Also, what has been disclosed is an improved versatility crackfill vehicle having tanks supply for holding, periodically mixing and supplying a cold crackfilling emulsion and a liquid hardening agent to hand operated applicator wands.

BRIEF DESCRIPTION OF THE DRAWINGS

These and other objects and advantages of the present invention will be better understood with reference to the drawing figures in which like numerals represent like elements and in which.

DESCRIPTION OF THE PREFERRED EMBODIMENTS

Figure 1:
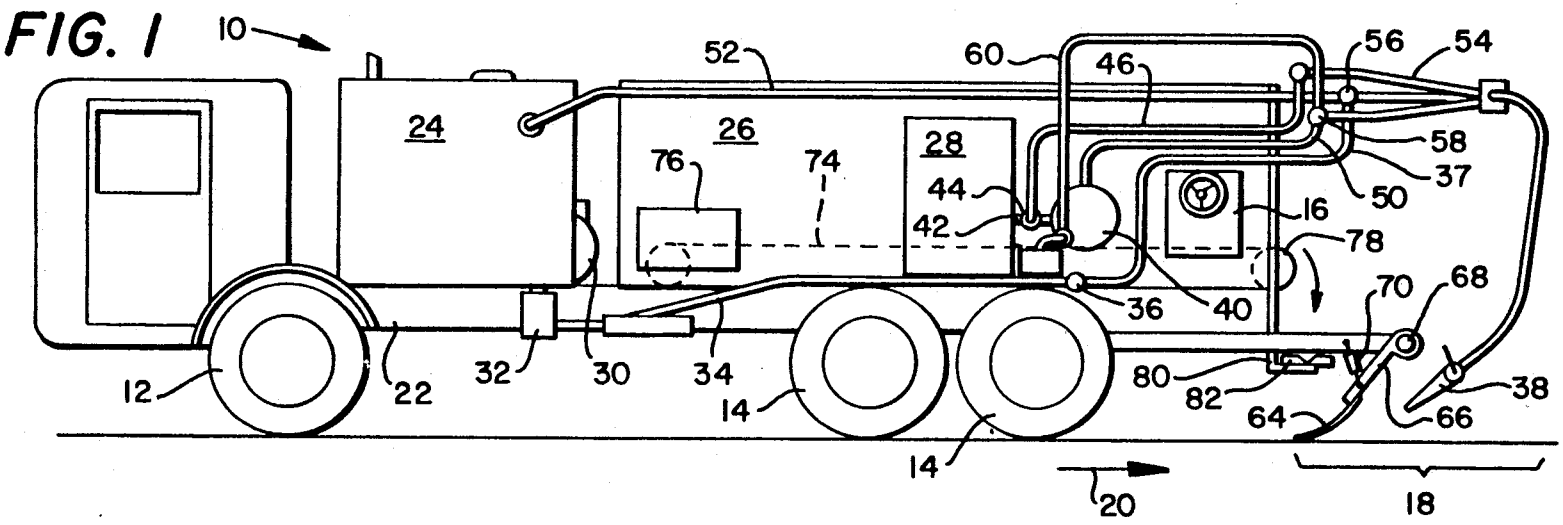
FIG. 1 is a side plan view of an improved crackfiller vehicle according to the present invention.

FIG. 1 shows an improved mixer vehicle 10 which may be of a standard truck having steering wheels 12 and primary load carrying wheels 14, which truck will preferably have control panel means 16 adjacent the crackfilling roadway area 18 to be repaired, so that the operator can move vehicle 10 toward the road repair area 18 as indicated by directional arrow 20.

On the bed 22 of the vehicle 10, there are appropriate material supply tanks, including asphaltic emulsion tank 24, sand or aggregate hopper 26, and hardening accelerator agent tank 28. In the case of asphaltic emulsions that require mixing, a mixer motor 30 is provided at the asphaltic emulsion tank 24 to periodically or continuously mechanically stir the asphaltic emulsion to maintain an appropriate consistency. The emulsion is pumped at pump 32 through conduit 34 toward the roadway area to be repaired and may be directed through a valve 36, either directly to the crackfilling wand 38 for application to roadway area 18, or alternatively, may be directed to mixing pump 40 for mixing with the hardening accelerator agent from tank 28 as will be explained more fully below.

The hardening accelerator agent, which is preferably salt water, is supplied from supply tank 28 through conduit 42 and may be directed either with the valve 44, either directly to the applicator wand 38 as through conduit 46 or may be directed into mixing pump 40 concurrently with crackfiller emulsion directed into mixer 40 via valve 36, as indicated above. The premixed emulsion and hardening agent are then pumped through conduit 50 to applicator wand 38.

This permits using an anionic emulsions in tank 24 as well as other crackfiller materials with the greatest versatility. Preferably, in the case of anionic crackfillers, it may be desirable to either mix the hardening agent with the anionic emulsion as it is being dispensed at the applicator wand, or alternatively it may be helpful to pre-mix the hardening accelerator agent with the anionic crackfiller emulsion.

With the crackfiller emulsion, it is desirable to have a return conduit 52 which avoids pump stalling when the applicator wands are not in the open position, the excess material merely flows back to crackfiller tank 24. In this regard, it is beneficial to avoid adding hardening accelerator agent to crackfiller tank 24 such that the conduit 46 or accelerator agent is not directly interconnected with the return hose 52. An independent emulsion and accelerator supply hose 54 is provided to the applicator wand 38. When valve 36 directs the emulsion to the applicator wand through conduit 37, it proceeds through an open valve 56. Valve 58 is in a closed position to prevent any pre-mixed emulsion and hardening agent in conduit 50 from entering into the return hose 52.

In the event that the emulsion is directed at valve 36 into mixer pump 40, valve 56 will be closed to prevent the pre-mixed emulsion and hardening agent from entering into the return circuit 52. Activation of valve 58 will be coordinated to also incorporate a return circuit 60 to cycle the pre-mixed emulsion and hardening agent back into pump 40.

Alternatively, a discharge valve 62 can allow the premix to discharge into collecting tank 64 for appropriate disposal. The accelerating agent and crackfiller mix produced in conduit 50 from pump 40 will have a tendency for rapid hardening such that it is desirable to permit complete purging of the pre-mixed system when a job is completed, or periodically during the job to prevent buildup of hardened asphalt material.

Figure 2:
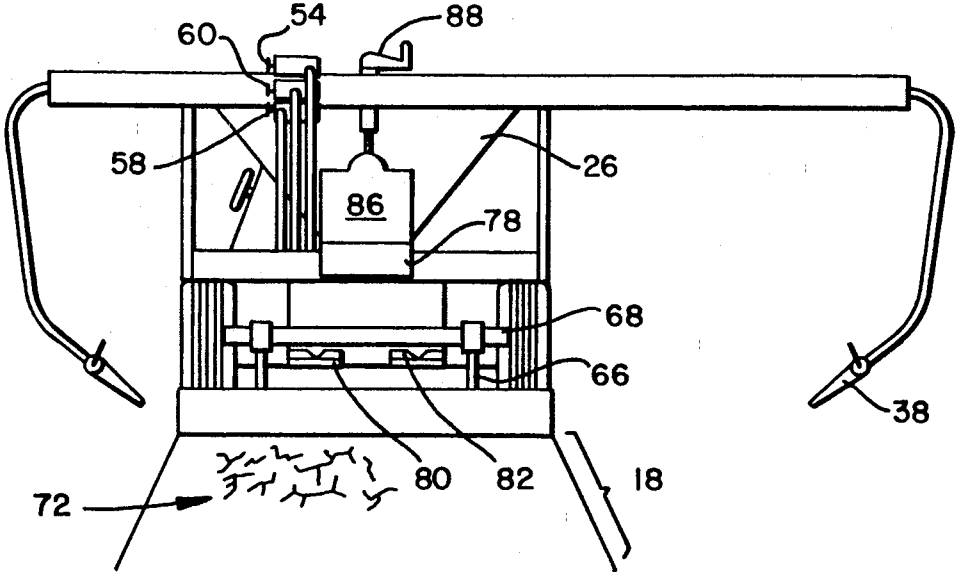
FIG. 2 is a back plan view of the crackfiller vehicle of FIG. 1.

With reference to both FIG. 1 and FIG. 2, it is desirable when filling cracks to smooth the crackfilled areas level with the roadway surface. It has been uniquely discovered that rather than using hand squeegees, which is a labor-intensive operation, a rubber squeegee drag blade 64 is provided and supported as on a pair of support arms 66 pivotably at 68 from the frame 22 of vehicle 10. The arm 66 may be conveniently adjusted up and down either mechanically, hydraulically, or otherwise, as schematically depicted at adjusting means 70. This allows the rubber blade 64 to apply an appropriate amount of pressure so that it is dragged over the crackfilled area 18 as the vehicle 10 is driven from control 16 in the direction as indicated by arrow 20. This is particularly advantageous in the event that there are multiple cracks to be filled and especially, in the case of alligator cracking as shown in FIG. 2 at 72. A substantially roughened road surface which may exist over a significantly large portion of the roadway can be quickly and economically smoothed after the crackfill material is applied.

To further facilitate rapid usability of the roadway, and also to facilitate increased strength of the crackfilling operation, an aggregate or sand is provided from hopper 26 along conveyor 74 which may be driven by motor 76 to deposit sand or aggregate at 78 downward onto the asphalt emulsion filled cracks. The aggregate may be deposited on a platform 80, and independently shoveled on widely dispersed individual cracks. Alternatively, the aggregate or sand may be directed to sand spreading impellers 82 to disperse the aggregate or sand over a large area. The sand may be applied either behind squeegee 74 by providing a deflecting panel between pivot arms 66 or, alternatively as shown, the sand may be spread ahead and behind squeegee blade 64 so that the aggregate is moved and pressed into the crackfilled areas with the rubber squeegee blade 64. The amount of sand can be adjusted using gate 86 and adjustment means 88.

While the invention has been disclosed in connection with preferred embodiments, it is not intended to limit the scope of the invention to the embodiments shown but to the contrary, is intended to encompass such modifications, variations, and equivalents within the broadest scope of the appended claims.

What is claimed is:

1. A vehicle for transporting and dispensing materials required for filling and repairing cracks in roadways and highways or similar, said vehicle comprising;

a) a supply tank means mounted on said vehicle for asphalt mix or emulsion or the like liquid crack-filling material;

b) hose means leading from said asphalt supply tank to a dispensing area adjacent said vehicle;

c) a applicator means connected to said hose for directing crack-filling materials from said asphalt supply tank into cracks in the roadway;

d) a resilient squeegee blade supported from said vehicle for dragging across the roadway dispensing area after crack-filler material is directed into cracks so that the crack-filler material is leveled;

e) a hopper for carrying sand, rock chips, or other substantially dry structural material for covering the liquid crack-filler material and binding therewith to form in the aggregate substantially firm roadway surface;

f) a dispensing conveyance means attached to said vehicle adjacent said dispensing area; and g) a conveyor interconnected with said hopper for moving sand or other structural filler material therefrom to said dispensing conveyance means broadcaster.

2. The vehicle for transporting and dispensing materials required for filling and repairing cracks in roadways and highways or similar as in claim 1, further comprising a pivotable arm connected between said vehicle and said resilient squeegee blades to allow the blade to be adjustably raised and lowered relative to the roadway.

3. A vehicle for transporting and dispensing materials required for filling and repairing cracks in roadways and highways or similar as in claim 1, wherein said resilient squeegee blade comprises:

a) a substantially rigid support blade supported horizontally disposed from said vehicle; and b) a rubber blade suspended horizontally disposed from said support blade for flexible contact across the roadway.

4. The vehicle for transporting and dispensing materials required for filling and repairing cracks in roadways and highways or similar as in claim 1 and wherein said structural filler material is dispensed at least partially ahead of said squeegee blade in the direction of motion.

5. The vehicle for transporting and dispensing materials required for filling and repairing cracks in roadways and highways or similar as in claim 1 wherein said structural material is broadcast onto the roadway behind the squeegee.

6. A vehicle for transporting and dispensing materials for filling and repairing cracks in roadways as in claim 1 further comprising:

a) a supply tank for liquid hardening accelerator agent; and b) hose means leading from said hardening agent tank to said dispensing area.

* * * * *

UNITED STATES PATENT AND TRADEMARK OFFICE

CERTIFICATE OF CORRECTION

PATENT NO. 5,232,306

DATED August 3, 1993

INVENTOR(S) Carl L. Sterner

It is certified that error appears in the above-identified patent and that said Letters Patent is hereby corrected as shown below:

In the Claims:

Claim 1, Column 4, line 29, delete "broadcaster".

Signed and Sealed this

Twelfth Day of April, 1994

Bruce Lehman

*Attest:*

BRUCE LEHMAN

*Commissioner of Patents and Trademarks*

*Attesting Officer*